US008004489B2

(12) United States Patent
Chen

(10) Patent No.: US 8,004,489 B2
(45) Date of Patent: Aug. 23, 2011

(54) IMAGE PROCESSING METHOD OF BACKLIGHT ILLUMINATION CONTROL AND DEVICE USING THE SAME

(75) Inventor: Shing-Chia Chen, Tainan County (TW)

(73) Assignee: Himax Technologies Limited, Tainan (TW)

( * ) Notice: Subject to any disclaimer, the term of this patent is extended or adjusted under 35 U.S.C. 154(b) by 952 days.

(21) Appl. No.: 11/939,296

(22) Filed: Nov. 13, 2007

(65) Prior Publication Data

US 2009/0122000 A1 May 14, 2009

(51) Int. Cl.
*G09G 3/36* (2006.01)

(52) U.S. Cl. ..... 345/102; 345/87; 345/204; 345/211; 345/213

(58) Field of Classification Search ..... 345/55, 345/84, 87, 89, 102, 204, 211, 213, 581, 345/589, 600
See application file for complete search history.

(56) References Cited

U.S. PATENT DOCUMENTS 7,825,938 B2 * 11/2010 Chen ..... 345/589
2006/0209005 A1 * 9/2006 Pedram et al. ..... 345/102

* cited by examiner

*Primary Examiner* — My-Chau T Tran
(74) *Attorney, Agent, or Firm* — J.C. Patents

(57) ABSTRACT

An image processing method of backlight illumination control is provided herein. First, an image including a plurality of pixels is received, wherein a first function is a relation between a gray-level value of one of the pixels and a displaying illumination of a backlight. The first function is compared with a characteristic function to obtain the specific function, wherein the characteristic function is a relation between the gray-level value and a predetermined displaying illumination of the backlight, and the specific function is a relation between the gray-level value and a remapped gray-level value. The specific function is utilized to remap the gray-level -value so as to adjust the displaying illumination. Therefore, the present invention enhances the displaying illumination for better visual quality.

8 Claims, 6 Drawing Sheets

IMAGE PROCESSING METHOD OF BACKLIGHT ILLUMINATION CONTROL AND DEVICE USING THE SAME

BACKGROUND OF THE INVENTION

1. Field of the Invention

The present invention relates to an image processing method of backlight illumination control, and more particularly, to adjust the displaying illumination of a backlight by remapping the gray-level values of the pixels in an image.

2. Description of Related Art

With great advance in the techniques of electro-optical and semiconductor devices, flat panel displays, such as liquid crystal displays (LCD), have enjoyed burgeoning development and flourished in recent year. Due to the numerous advantages of the LCD, such as low power consumption, free of radiation, and high space utilization, the LCD has become the main stream in the market. An LCD includes a liquid display panel and a backlight module. The liquid display panel has no capacity of emitting light by itself so that the backlight module is arranged below the liquid display panel to provide the surface light source for the liquid crystal display panel so as to perform the display function.

When an image is displayed through the LCD, a driving voltage is applied to the liquid crystal for controlling a rotation angle of the liquid crystal and thereby controlling a light transmission of the liquid crystal, which the driving voltage is related to a gray-level value of the image. Nevertheless, the liquid crystal display panel has non-linear light transmission with respect to the driving voltage so that a gamma correction apparatus is needed to adjust the driving voltage.

FIG. 1 is a curve diagram of light output over the driving voltage with no gamma correction. Referring to FIG. 1, the light output and the driving voltage are normalized to maximum 1 and the lower driving voltages (or the darker gray-level values of the image) are displayed too dark due to the lower light transmission. There are two categories of gamma correction methods. One is analog gamma correction method and the other is digital gamma correction method.

The analog gamma correction method utilizes a plurality of resistances in series connection to adjust the driving voltage directly according to a fixed gamma curve, such as $\gamma=2.2$, which the driving voltage is converted from the gray-level value of the image. The digital gamma correction adjusts the gray-level value of the image according to the fixed gamma curve so that the adjusted gray-level value of the image can be converted to a proper driving voltage for controlling the light transmission of the liquid crystal.

Besides, if the backlight illumination decreases, such as power saving, the whole luminance of the image displayed would decrease on the premise of no gamma correction. The designer utilizes the higher gamma curve to adjust the gray-level value of the image so as to enhance the backlight illumination for better visual quality. FIG. 2 is a curve diagram of the backlight illumination over the gray-level value of the image. Referring to FIG. 2, the curve 201 and the curve 202 respectively represents the backlight illumination over the gray-level value of the image when the duty cycle of providing the backlight is 100% and 80%. Apparently, in the same coordinate of the gray-level value, the curve 202 has lower backlight illumination than the curve 201.

The curve 203 represents the adjusted backlight illumination over the gray-level value by utilizing the gamma curve, such as $\gamma=2.0$, when the duty cycle of providing the backlight is 80%. This adjustment of the gamma correction is restricted on that the adjusted backlight illumination of the curve 203 can't match the backlight illumination of the curve 201 when the gray-level value gets higher. Therefore, how to solve this problem becomes an important issue to be researched and discussed.

SUMMARY OF THE INVENTION

Accordingly, the present invention provides an image processing method of backlight illumination control and a device using the same. The image processing method of backlight illumination control remaps the gray-level values of the image according to the characteristic function of the gray-level value to the predetermined displaying illumination of the backlight. Therefore, the display quality of the image can be enhanced when the backlight illumination decreases or the duty cycle of providing the backlight decreases.

An image processing method of backlight illumination control is provided in the present invention. First, an image including a plurality of pixels is received, wherein a first function is a relation between a gray-level value of one of the pixels and a displaying illumination of a backlight. The first function is compared with a characteristic function to obtain the specific function, wherein the characteristic function is a relation between the gray-level value and a predetermined displaying illumination of the backlight, and the specific function is a relation between the gray-level value and a remapped gray-level value. Next, the specific function is utilized to remap the gray-level value so as to adjust the displaying illumination.

An image processing device of backlight illumination control is provided in the present invention. The image processing device of backlight illumination control includes an analysis module and a control module. The analysis module receives an image including a plurality of pixels and compares a first function, which is a relation between a gray-level value of one of the pixels and a displaying illumination of a backlight, with a characteristic function to obtain a specific function, wherein the characteristic function is a relation between the gray-level value and a predetermined displaying illumination of the backlight and the specific function is a relation between the gray-level value and a remapped gray-level value. The control module is coupled to the analysis module and used for utilizing the specific function to remap the gray-level value so as to adjust the displaying illumination.

The present invention provides an image processing method of backlight illumination control and a device using the same that remap the gray-level values of the image according to the characteristic function of the gray-level value to the predetermined displaying illumination of the backlight. The specific function used for remapping the gray-level values of the images is obtained by comparing the relation between the gray-level values of the image and the displaying illumination (i.e. the first function) with the relation between the gray-level values of the image and the predetermined displaying illumination (i.e. the characteristic function). Therefore, a factor of the backlight illumination is taken into consideration for adjusting the applied voltage to drive the pixel and thereby the display quality of the image can be enhanced.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 3:
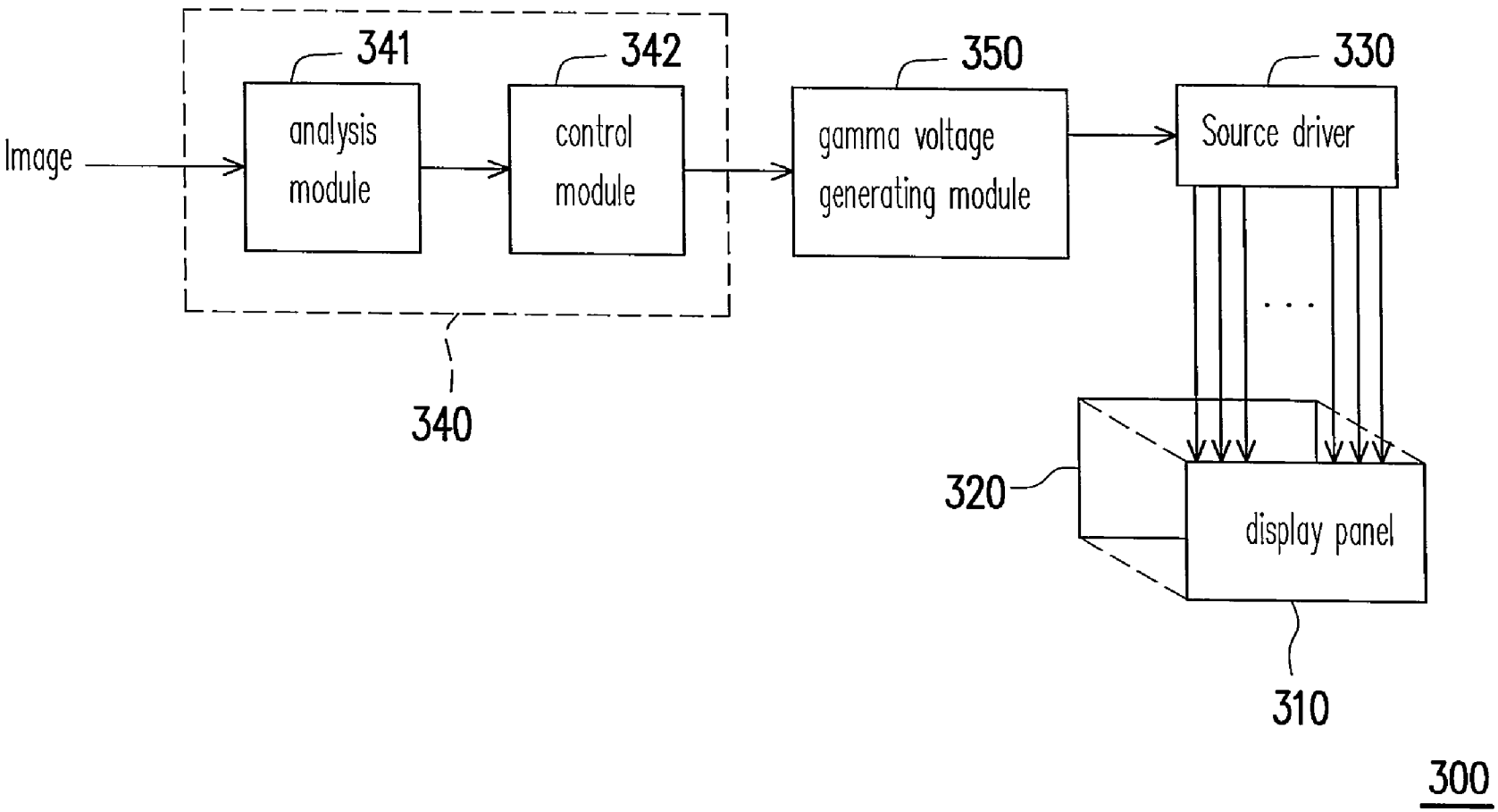
FIG. 3 is a block diagram of a display device according to one embodiment of the present invention.

FIG. 3 is a block diagram of a display device according to one embodiment of the present invention. Referring to FIG. 3, the display device 300 includes a display panel 310, a backlight module 320, a source driver 330, an image processing device of backlight illumination control 340 and the gamma voltage generating module 350, wherein the image processing device of backlight illumination control 340 includes an analysis module 341 and a control module 342. In the embodiment of the present invention, a transmissive display device is supposed as the display device 300. The backlight module 320 is used for providing a backlight to the display panel 310 and the source driver 330 outputs a driving voltage to the display panel 310 according to a gray-level value of one of the pixels for displaying an image, wherein the image includes a plurality of pixels.

Since the amount of the backlight illumination directly affects the luminance appearance of the image, the image perceived by human eyes is too dark when the backlight illumination decreases. There is a relation called a characteristic function between the gray-level value of one of the pixels and a predetermined displaying illumination of the backlight, such as the curve 201 in FIG. 2. Based on the gamma curve with $\gamma=2.2$, the embodiment of the present invention measures the predetermined displaying illumination as for the gray-level value of the one of the pixel. The gamma curve with $\gamma=2.2$ is specified by Video Electronics Standards Association (VESA) according to the characteristic of human eyes that can discriminate the light luminance. Besides, there is a relation called a first function between the gray-level value of the one of the pixels and an actual displaying illumination of the backlight, such as the curve 202 in FIG. 2. The analysis module 341 receives the image and compares the first function with a characteristic function to obtain a specific function.

Figure 1:
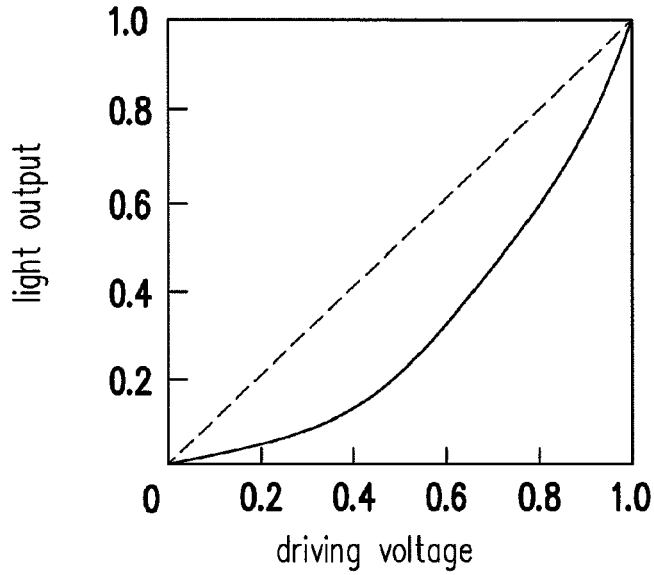
FIG. 1 (PRIOR ART)
FIG. 1 is a curve diagram of light output over the driving voltage with no gamma correction.
Figure 2:
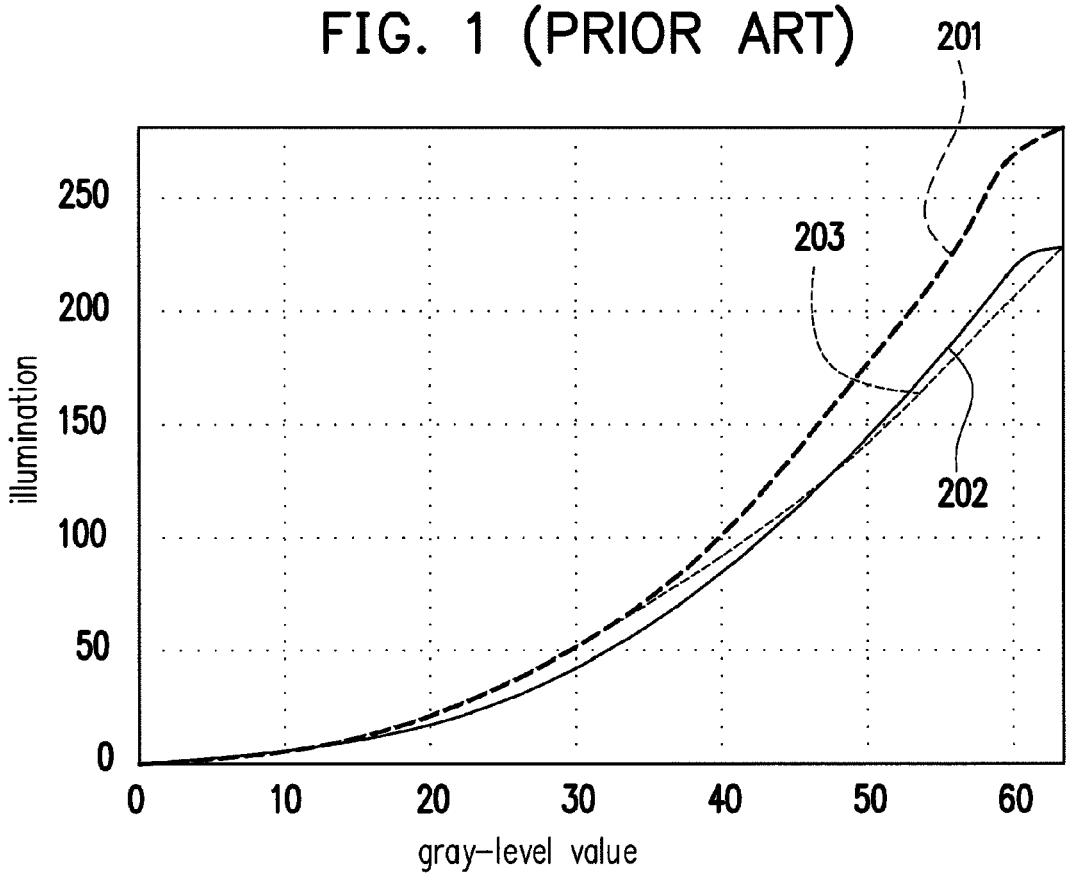
FIG. 2 (PRIOR ART)
FIG. 2 is a curve diagram of the backlight illumination over the gray-level value of the image.

For example, referring to FIG. 2, when the gray-level value G equals 50, the displaying illumination L1 of the backlight in the curve 202 is about 150 and the predetermined displaying illumination L2 of the backlight in the curve 201 is about 170. In mathematics form, the first function can be expressed as F1(G)=L1 and the characteristic function can be expressed as F2(G)=L2, such as F1(50)=150 and F2(50)=170. The analysis module 341 compares the first function with the characteristic function to calculate the remapped gray-level value G' that can make F1(G') nearest equal the predetermined displaying illumination L2 of the backlight, such as G'=55 and F1(55)=170. Hence, the specific function, which is a relation between the gray-level value G and the remapped gray-level value G', is obtained.

Figure 4A:
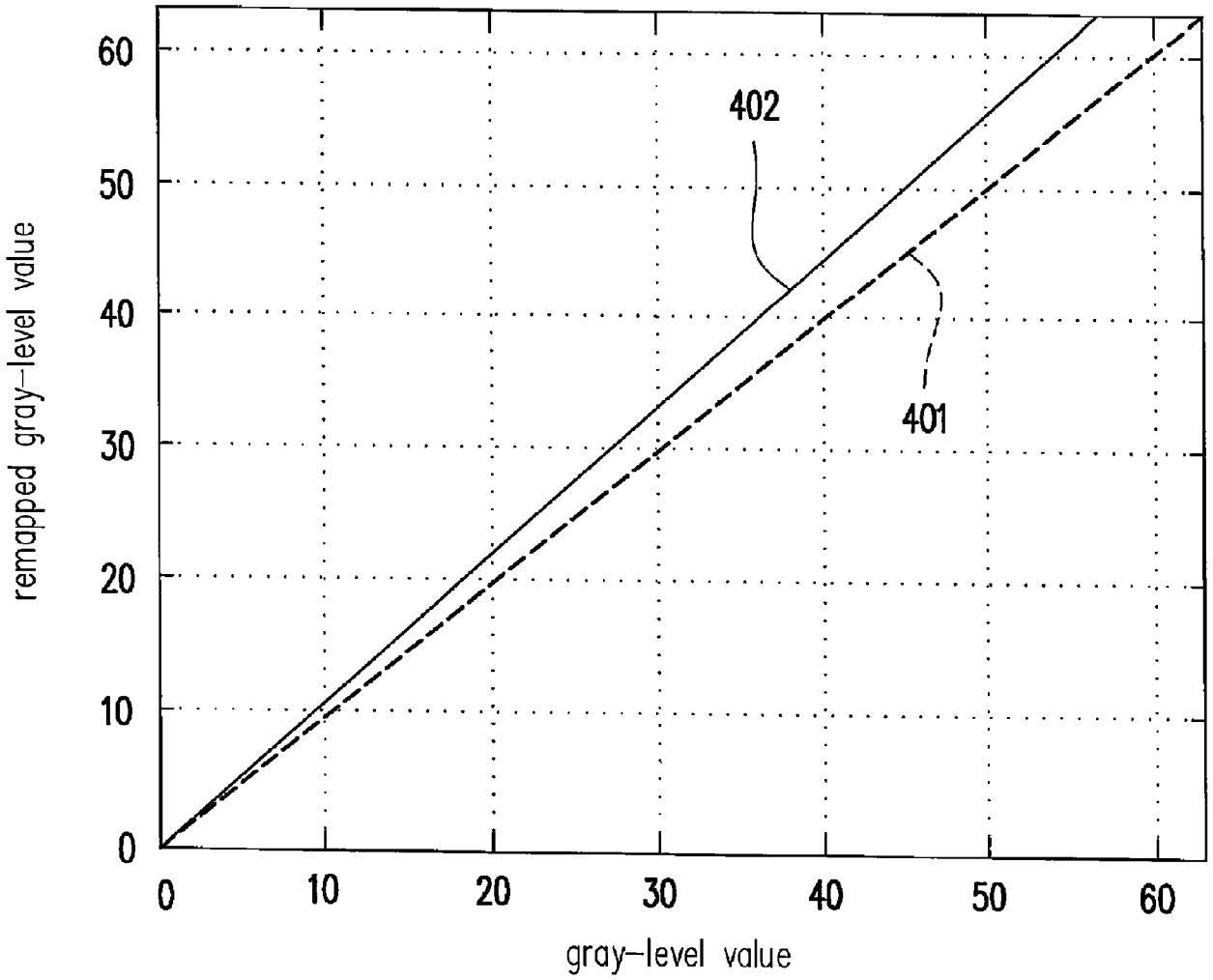
FIG. 4A is a curve diagram of the specific function according to one embodiment of the present invention.

FIG. 4A is a curve diagram of the specific function according to one embodiment of the present invention. Referring to FIG. 4A, the curve 401 is drawn according to a second function which is a relation having a ratio one to one of the gray-level value to the remapped gray-level value, and the curve 402 is drawn according to the said specific function. Referring to FIG. 3, the control module 342 is coupled to the analysis module 341 and utilizes the specific function to remap the gray-level value of the one of the pixels so as to adjust the displaying illumination of the backlight. The gamma voltage generating module 350 is coupled to the control module 342 and generates a gamma voltage corresponding to the remapped gray-level value by referring a fixed gamma function, wherein the gamma function is a relation between the gray-level value and the gamma voltage. The gamma voltage is transmitted to the source driver 330 as the driving voltage to drive the pixel.

Besides, as shown in FIG. 4A, there is an upper limit of the remapped gray-level value about 63 in the curve 402 so that the displaying illumination of the backlight corresponding to the gray-level values between 56~63 can't be discriminated by human eyes, which the gray-level values between 56~63 are all remapped to the remapped gray-level value 63. Hence, in another embodiment of the present invention, the analysis module 341 further utilizes the second function and the specific function to obtain an upper-limit function, wherein the upper-limit function is a relation between the gray-level value and the remapped gray-level value, and a difference between the remapped gray-level value of the specific function and the remapped gray-level value of the second function equals a difference between the remapped gray-level value of the upper-limit function and the remapped gray-level value of the specific function as for the same gray-level value. The control module 342 utilizes a third function to remap the gray-level value of the one of the pixel, wherein the third is a relation between the gray-level value and the remapped gray-level, and the remapped gray-level value of the third function is between the remapped gray-level value of the upper-limit function and the remapped gray-level value of the second function as for the same gray-level value.

Figure 4B:
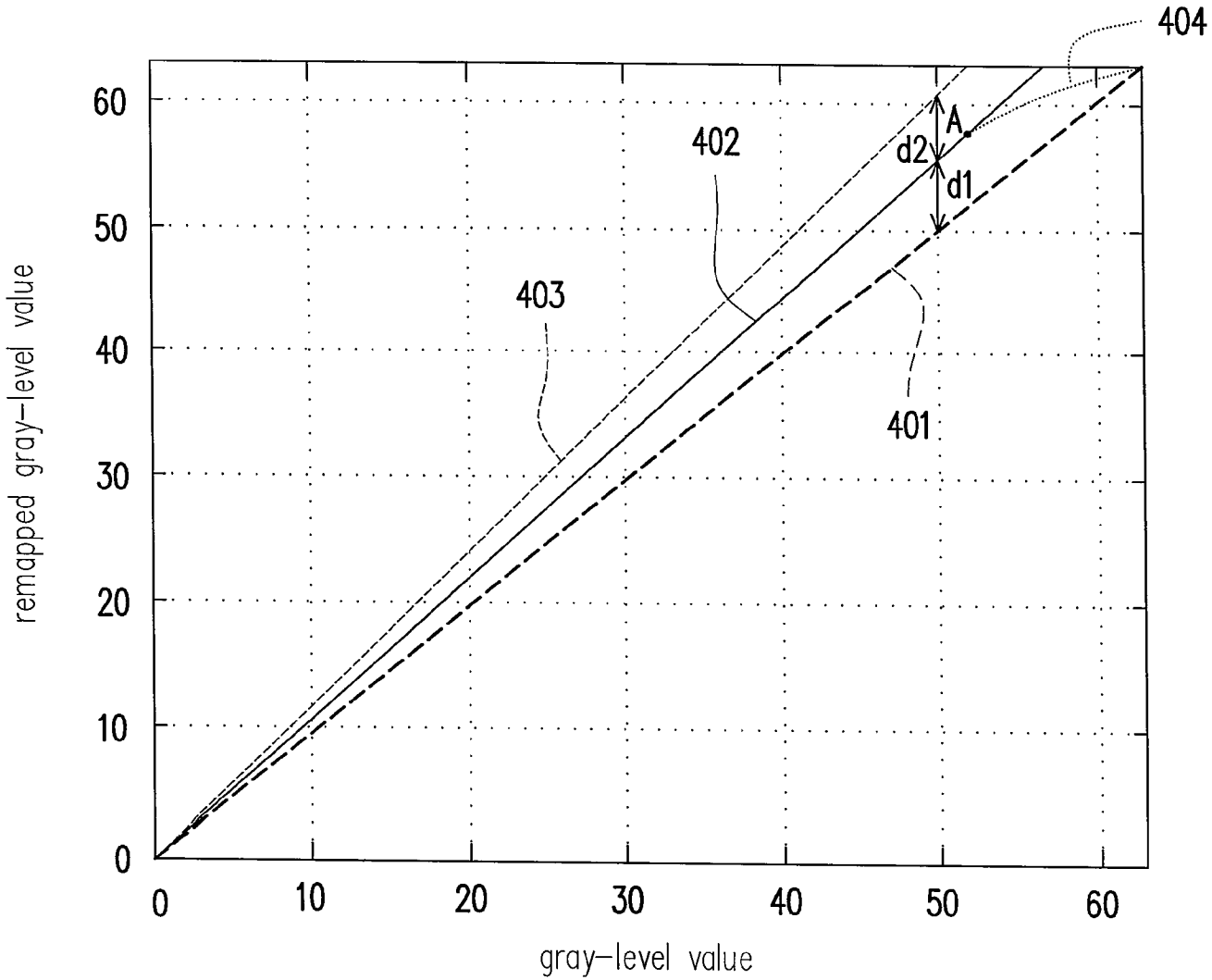
FIG. 4B is a curve diagram of the upper-limit function according to one embodiment of the present invention.

FIG. 4B is a curve diagram of the upper-limit function according to one embodiment of the present invention. Referring to FIG. 4B, the curve 403 is drawn according to the upper-limit function, wherein the difference d1 of the remapped gray-level value equals the difference d2 of the remapped gray-level value as for the same gray-level. A turning point A is marked in the curve 402 since the remapped gray-level value of the upper-limit function as for the same gray-level value of the turning point A is upper limit.

In order to make human eyes discriminate the backlight illumination levels when the remapped gray-level reaches the upper limit, a third function as shown in the curve 404 is utilized to remap the gray-level value so as to adjust the displaying illumination of the backlight, wherein the slope of the curve 404 is less than the slope of the curve 402 when the gray-level value gets higher than the gray-level value of the turning point A.

Figure 4C:
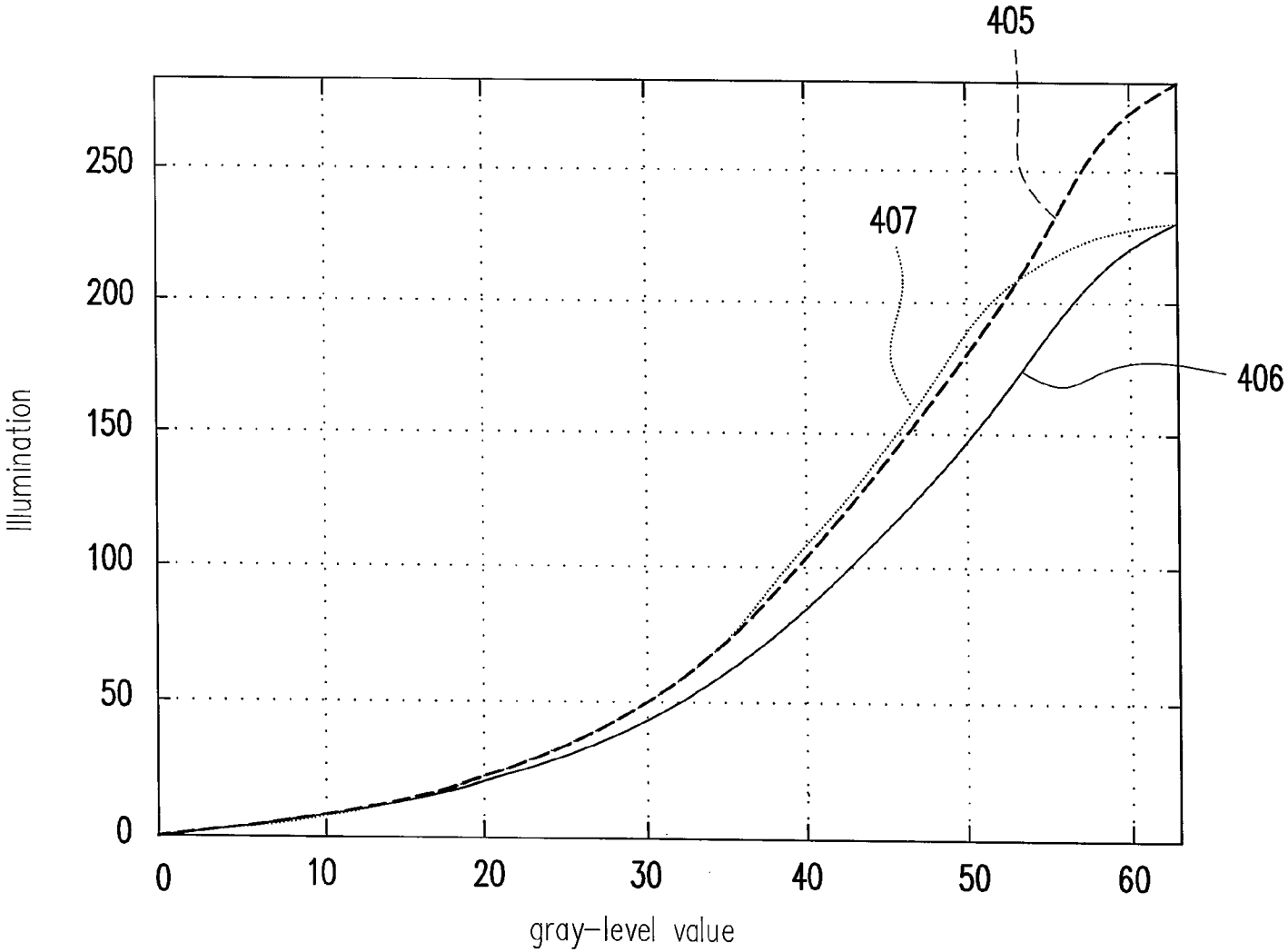
FIG. 4C is a curve diagram of the backlight illumination over the gray-level value according to one embodiment of the present invention.

FIG. 4C is a curve diagram of the backlight illumination over the gray-level value according to one embodiment of the present invention. Referring to and FIG. 4C, the curve 405 and the curve 406 respectively represent the backlight illumination over the gray-level value when the duty cycle of providing the backlight is 100% and 80%. The embodiment of the present invention utilizes the said third function to remap the gray-level value, and the curve 407 represents the adjusted displaying illumination of the backlight over the gray-level value when the duty cycle of providing the backlight is 80%. Apparently, the curve 407 nearly matches the curve 405 so that the display quality of the image can enhanced through the image processing of the embodiment of the present invention when the backlight illumination decreases.

It is noted that the turning point A in the curve 402 would change according to the image content, and any function, which its remapped gray-level value is between the remapped gray-level value of the upper-limit function and the remapped gray-level value of the second function as for the same gray-level value, can be utilized to perform the image processing of backlight illumination control so that the present invention is not limited in that range. Besides, in another embodiment of the present invention, the image processing device of the backlight illumination control 340 can be integrated into the source driver 330.

Figure 5:
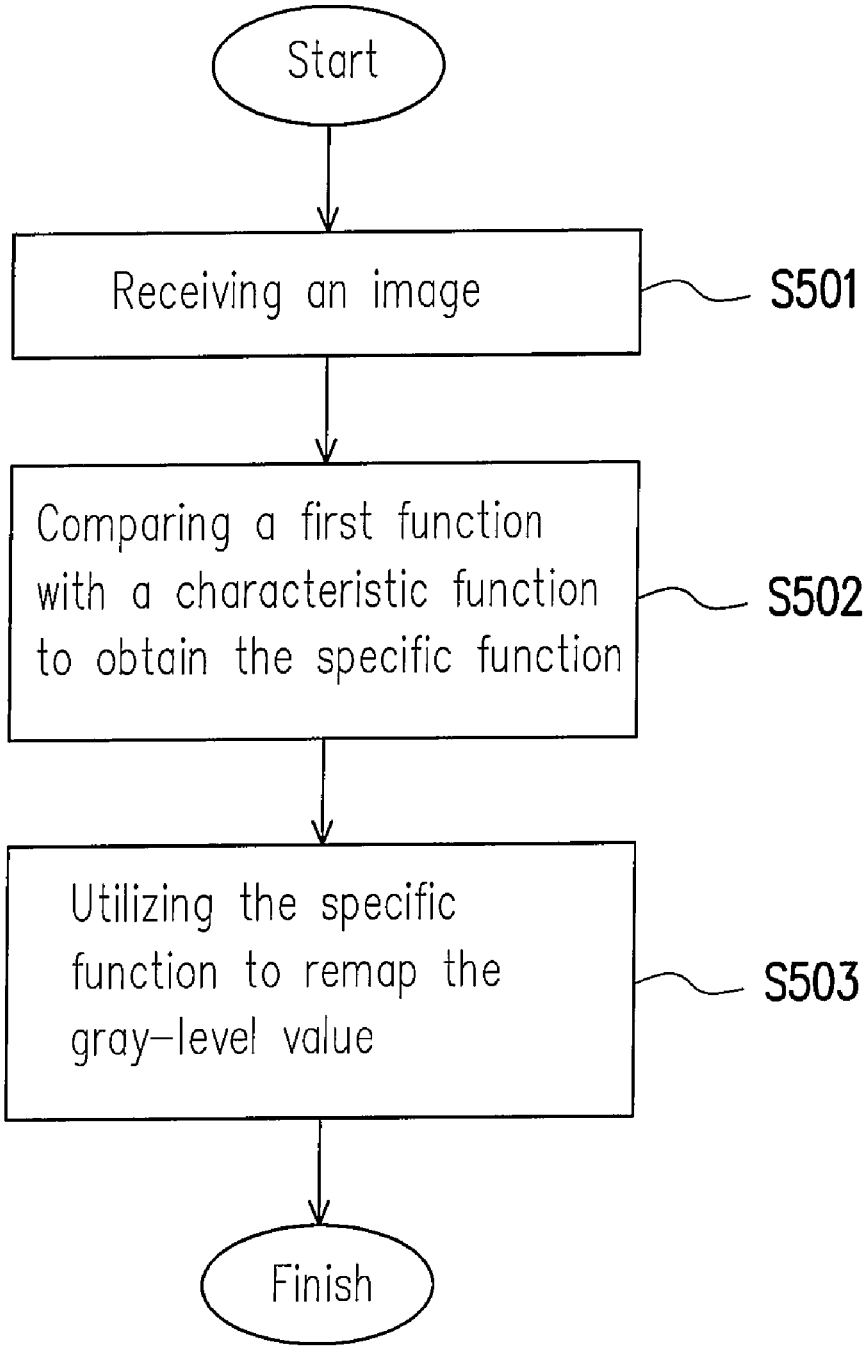
FIG. 5 is a flow chart of the image processing method of backlight illumination control according to one embodiment of the present invention.

According to the embodiments described above, the steps of the following method could be generalized. FIG. 5 is a flow chart of the image processing method of backlight illumination control according to one embodiment of the present invention. Referring to FIG. 5, in the step S501, an image including a plurality of the pixels is received, wherein there is a relation called first function between a gray-level value of one of the pixels and a displaying illumination of a backlight. Next, in the step S502, the first function is compared with a characteristic function to obtain the specific function, wherein the characteristic function is a relation between the gray-level value of the one of the pixels and a predetermined displaying illumination of the backlight and the specific function is a relation between the gray-level value and a remapped gray-level value. In the step S503, the specific function is utilized to remap the gray-level value so as to adjust the displaying illumination of the backlight.

In summary, since the amount of the backlight illumination directly affects the display quality of the image, the embodiments of the present invention analyze a relation between the gray-level value of the image and the displaying illumination of the backlight, and remap the gray-level value of the image to adjust the displaying illumination of the backlight according to the characteristic function which is a relation between the gray-level value of the image and the predetermined displaying illumination of the backlight. Therefore, even if the backlight illumination decreases, the embodiments of the present invention can enhance the display quality of the image through a flexible image processing. The embodiments of the present invention are easy to be implemented and have competitiveness in the market because of low complexity and low cost.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. An image processing method of backlight illumination control, comprising:

receiving an image, wherein the image comprises a plurality of pixels and a first function is a relation between a gray-level value of one of the pixels and a displaying illumination of a backlight;

comparing a first function with a characteristic function to obtain the specific function, wherein the characteristic function is a relation between the gray-level value and a predetermined displaying illumination of the backlight and the specific function is a relation between the gray-level value and a remapped gray-level value;

utilizing the specific function to remap the gray-level value so as to adjust the displaying illumination; and generating a gamma voltage corresponding to the remapped gray-level value by referring a fixed gamma function, wherein the fixed gamma function is a relation between the gray-level value and the gamma voltage.

2. The image processing method of backlight illumination control as claimed in claim 1, wherein the step of comparing the first function with the characteristic function to obtain the specific function comprises:

analyzing the first function, wherein the first function is expressed as F1(G)=L1, G is the gray-level value, and L1 is the displaying illumination of the backlight;

analyzing the characteristic function, wherein the characteristic function is expressed as F2(G)=L2, and L2 is the predetermined displaying illumination of the backlight;

calculating the remapped gray-level value G' making the first function F1(G') nearest equal the predetermined displaying illumination L2 of the backlight.

3. The image processing method of backlight illumination control as claimed in claim 1, the step of utilizing the specific function to remap the gray-level value so as to adjust the displaying illumination further comprising:

utilizing a second function which is a relation having a ratio one to one of the gray-level value to the remapped gray-level value and the specific function to obtain an upper-limit function, wherein the upper-limit function is a relation between the gray-level value and the remapped gray-level value, and a difference between the remapped gray-level value of the specific function and the remapped gray-level value of the second function equals a difference between the remapped gray-level value of the upper-limit function and the remapped gray level value of the specific function as for the same gray-level value; and utilizing a third function to remap the gray-level value, wherein the third function is a relation between the gray-level value and the remapped gray-level value, and the remapped gray-level value of the third function is between the remapped gray-level value of the upper-limit function and the remapped gray-level value of the second function as for the same gray-level value.

4. An image processing device of backlight illumination control, comprising:

an analysis module, for receiving an image comprising a plurality of pixels and comparing a first function with a characteristic function to obtain a specific function, wherein the first function is a relation between a gray-level value of one of the pixels and a displaying illumination of a backlight, the characteristic function is a relation between the gray-level value and a predetermined displaying illumination of the backlight, and the specific function is a relation between the gray-level value and a remapped gray-level value;

a control module, coupled to the analysis module for utilizing the specific function to remap the gray-level value so as to adjust the displaying illumination; and a gamma voltage generating module, coupled to the control module for generating a gamma voltage corresponding to the remapped gray-level value by referring a fixed gamma function which is a relation between the gray-level value and the gamma voltage.

5. The image processing device of backlight illumination control as claimed in claim 4, wherein the analysis module utilizes the first function expressed as F1(G)=L1 and the characteristic function expressed as F2(G)=L2 to calculate the remapped gray-level value G' making the first function F1(G') nearest equal the predetermined displaying illumination L2 of the backlight.

6. The image processing device of backlight illumination control as claimed in claim 4, wherein the analysis module further utilizes a second function which is a relation having a ratio one to one of the gray-level value to the remapped gray-level value, and the specific function to obtain an upper-limit function, which the upper-limit function is a relation between the gray-level value and the remapped gray-level value, and a difference between the remapped gray-level value of the specific function and the remapped gray-level value of the second function equals a difference between the remapped gray-level value of the upper-limit function and the remapped gray-level value of the specific function as for the same gray-level value, and the control module utilizes a third function to remap the gray-level value, which the third function is a relation between the gray-level value and the remapped gray-level value, and the remapped gray-level value of the third function is between the remapped gray-level value of the upper-limit function and the remapped gray-level value of the second function as for the same gray-level value.

7. A source driver, comprising the image processing device of backlight illumination control as claimed in claim 4.

8. A display device, comprising the image processing device of backlight illumination control as claimed in claim 4.

* * * * *